United States Patent [19]

Kirk

[11] Patent Number: 4,842,265

[45] Date of Patent: Jun. 27, 1989

[54] MULTI-MODE CPM PHYSIOTHERAPY FOOT MANIPULATING DEVICE

[76] Inventor: Chester E. Kirk, 6780 Carlisle Pike, Mechanicsburg, Pa. 17055

[21] Appl. No.: 131,409

[22] Filed: Dec. 10, 1987

[51] Int. Cl.[4] ..... A61H 1/02

[52] U.S. Cl. ..... 128/25 B; 128/25 R

[58] Field of Search ..... 128/25 R, 25 B, 26, 128/48, 49, 57; 272/73, 71, 145, 129, DIG. 4, 96

[56] References Cited

U.S. PATENT DOCUMENTS

| | | | |
|---|---|---|---|
| 2,534,412 | 12/1950 | Burnett et al. | 128/49 |
| 3,830,233 | 8/1974 | Hill | 128/57 X |
| 3,942,791 | 3/1976 | Dawson et al. | 128/57 X |
| 3,991,749 | 11/1976 | Zent | 128/26 X |
| 4,185,622 | 1/1980 | Swenson | 128/25 B |
| 4,230,098 | 10/1980 | Uetmatsu | 128/57 X |
| 4,477,072 | 10/1984 | DeCloux | 272/73 |
| 4,717,146 | 1/1988 | Noheura | 128/25 R X |

FOREIGN PATENT DOCUMENTS

| | | | |
|---|---|---|---|
| 2590482 | 5/1987 | France | 128/25 B |

*Primary Examiner*—Richard J. Apley

*Assistant Examiner*—Howard Flaxman

*Attorney, Agent, or Firm*—Sixbey, Friedman, Leedom & Ferguson

[57] ABSTRACT

A multi-mode physiotherapy foot manipulating device, in accordance with the preferred embodiments, is comprised of a portable unit that may be strapped onto the foot of a bed, table, or the like, and which produces manipulative treatments through the use of oscillating pivotal movements of pedal-like foot supports via a crank arrangement driven by a reversible electric motor. Operation of the motor in one direction will produce simultaneous dorsiflexion of both feet in unison, while reversing of the motor operation will produce a changeover into an alternating pedaling movement of the feet. In accordance with another feature, spring biased roller arms can be provided for massaging of the soles of the feet, openings being provided in foot supports of the device through which rollers on the ends of lever arms are displaced into engagement with the sole of a foot thereon under the force exerted by a spring connected between the base of the device and the lever arm.

16 Claims, 7 Drawing Sheets

MULTI-MODE CPM PHYSIOTHERAPY FOOT MANIPULATING DEVICE

BACKGROUND OF THE INVENTION

1. Field of the Invention

The present invention is directed to apparatus used for the therapeutic manipulation of a person's feet for purposes of stimulating blood and lymphatic circulation, exercising muscles of the legs and feet, as well as massaging of the soles of the feet. In particular, the present invention is directed to a single device capable of producing all of these therapeutic treatments.

2. Description of Related Art

The use of continuous passive motion (CPM) for the therapeutic stimulation of the feet and legs in many post surgical and nonsurgical situations is well known. In one form of such physiotherapy, an alternating flexion-extension of the ankle joint, that simulates walking, has been used for stimulation of blood circulation in the feet and legs of persons who are confined in a bed or to a wheelchair, or cannot exercise their legs for whatever reasons. In another mode of such physiotherapy, a simultaneous rhythmic dorsiflexion of both feet has been used to produce a pumping action that creates a dynamic upward force affecting fascia, muscle, skeletal, and abdominal mass as well as increasing the doming of the diaphragm. Such a pumping action applies intermittent positive-negative pressures on both the lungs and abdomen as well as stimulates circulation of fluids in the fascia, muscles, etc. in a way to produce a beneficial effect on body healing processes, as is reflected in various articles on the subject. Such therapy has also been found useful in reducing the risk of the occurrence of venous thrombosis in operative, bedridden and post operative patients.

Additionally, foot manipulation is used in physiotherapeutic treatment of such common foot problems as plantar faciatis and metatarsalgia, both of which are painful conditions of the sole of the foot. In particular, massaging of the soles of the feet has been used to reduce the inflammation of the plantar fascia and to reduce the pain at the heads of the metatarsal bones of the feet, symptomatic of these two common foot problems.

Traditionally, the above-noted manipulative physiotherapy has been performed by a trained physiotherapist. However, in recent years devices have been developed for the purpose of enabling such physiotherapeutic foot manipulation to be carried out without the use of a trained physiotherapist and particularly, in an unattended manner once the device has been activated. For example, for massaging the soles of the feet, such as for relieving the pain of plantar faciatis and metatarsalgia, numerous devices using rollers, balls, and vibrators have been developed. Likewise, for the alternating or simultaneous dorsiflexing of a person's feet, devices are known, for example, from Girten U.S. Pat. No. 3,370,584 and Rodgers, et al. U.S. Pat. No. 3,695,255, both of which can produce an alternating or simultaneous pedaling of a person's feet. Furthermore, from U.S. Pat. No. 4,003,374 to Mizrachy, a method and apparatus for the prevention of venous thrombosis is known which can massage the legs of a patient with rollers as well as produce a pedaling of the feet.

However, all of the physiotherapeutic devices known to date have suffered one or more deficiencies. That is, the prior art devices are complex and expensive to produce, on the one hand, or are either incapable of producing all of the above-noted types of therapeutic manipulations and/or difficult and/or time-consuming to convert from a mode usable for one type of physiotherapy to another.

Accordingly, there is still a need for a multi-mode CPM physiotherapy foot manipulating device that can be produced simply and economically, can produce all of the above-noted types of physiotherapeutic manipulations, and can be easily converted from one mode of physiotherapeutic manipulation to another mode of physiotherapeutic manipulation quickly and easily.

SUMMARY OF THE INVENTION

It is a primary object of the present invention to provide a multi-mode CPM physiotherapy foot manipulating device which is capable of producing either alternating or simultaneous dorsiflexion of the feet, with or without sole massage.

It is a further object of the present invention to provide a multi-mode CPM physiotherapy foot manipulating device which can be changed from one mode of operation to another mode of operation quickly, easily, and without the use of tools.

Still another object of the present invention is to provide a device that performs a physiotherapeutic flexing of the ankle joint via a device utilizing adjustable oscillating foot supports.

Yet another object of the present invention is to provide a device which performs massaging of the foot by applying rollers against and along the sole of the foot while producing a flexing of the foot.

A still further object of the present invention is to provide a multi-mode CPM physiotherapy foot manipulating device which is simple in construction, economical to produce, and easy to operate.

These and other objects are achieved in accordance with preferred embodiments of the present invention Which are comprised of a portable unit that may be strapped, for example, onto the foot of a bed, table or the like and which produces the manipulative treatments through the use of oscillating pivotal movements of pedal-like foot supports via a crank arrangement driven by a reversible electric motor.

In accordance with the preferred embodiments, operation of an electric motor in one direction will produce simultaneous dorsiflexion. While reversing of the motor operation will produce a changeover into an alternating pedaling movement. This changeover capability is attained by the provision of a lost-motion coupling in the drive train to only one of the two foot supports, whereby the phase relationship between the two pedals is shifted 180 degrees whenever motor operation is reversed.

In accordance with another feature of the preferred embodiments of the present invention, spring-biased roller arms can be provided for massaging of the soles of the feet. For this purpose, openings are provided in the foot supports through which rollers on the ends of lever arms are displaced into engagement with the sole of a foot thereon, under the force exerted by a spring connected between the base of the device and the lever arm. During oscillating of the foot supports, the roller travels lengthwise within the slot between the ball and arch of the foot. When use of the roller is not desired, the roller can be retracted from the opening and a cover plate snapped in place thereover.

These and further objects, features, and advantages of the present invention will become apparent from the following description when taken in connection with the accompanying drawings which show, for purposes of illustration only, several embodiments in accordance with the present invention.

BRIEF DESCRIPTION OF THE INVENTION

DETAILED DESCRIPTION OF THE PREFERRED EMBODIMENTS

Figure 1:
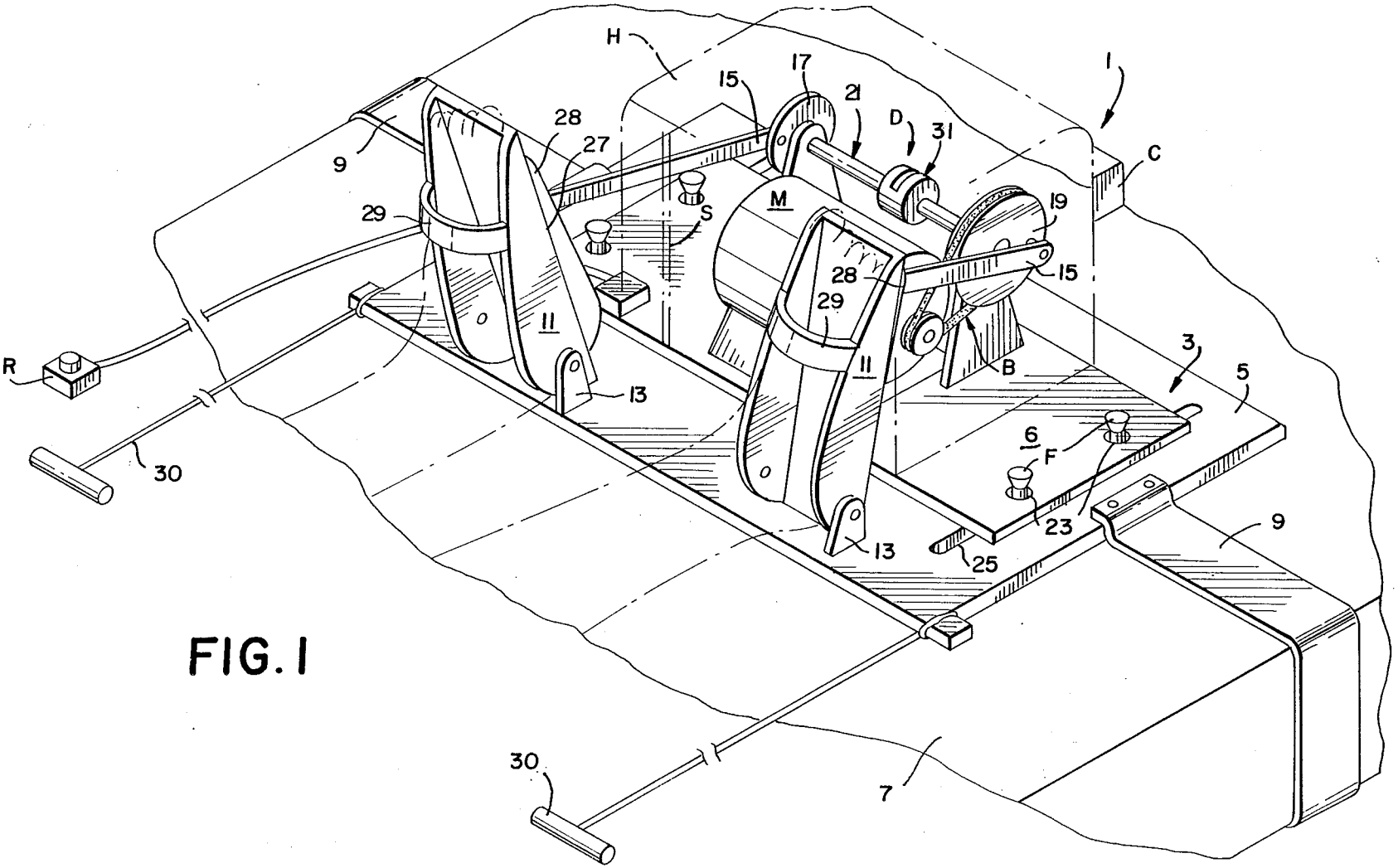
FIG. 1 is a perspective view of a first preferred embodiment in accordance with the present invention.

In FIG. 1, a first embodiment of a multi-mode physiotherapy foot manipulating device in accordance with the present invention is designated generally by the reference numeral 1. This foot manipulating device 1 has a support 3 which is in the form of a platform that includes a base plate 5 and an adjustment plate 6. The device 1 is designed to be portable, i.e., easily carried by hand from one use location to another, and to be strapped in place resting upon a bed, table, or the like 7, via fastening straps 9. A pair of pedal-like foot supports 11 is pivotally carried by the base plate 5 of the support 3 via hinges 13. A reversible electric drive motor M is disposed within a housing H (illustrated in phantom lines in FIG. 1) along with a drive means D that interconnects the reversible motor M with each of the foot supports 11.

The drive means D comprises a pair of crank arms 15, each of which is connected to a respective one of the foot supports 11 at an end of the crank arm which extends outwardly from the housing H via a slot S, formed therein. The opposite end of each crank arm is connected to a respective rotary disc 17, 19. The rotary discs 17, 19 are coupled to each other by a connector shaft 21 so that rotation of the disc 19 (by the belt B that is mounted upon the output shaft of the motor M) also drives rotary disc 17. Due to the eccentric mounting of the crank arms 15 to the rotary discs 17, 19, rotation of the discs 17, 19 causes the crank arms 15 to move forwardly and rearwardly relative to hinges 13, resulting in a pivoting of the foot supports 11, thereby producing a flexion and extension of the foot of the user about his or her ankle joint.

The range of pivotal movement of the foot supports 11, produced by the crank arms 15, is adjustable in two manners. Firstly, fasteners F, which extend through holes 23 in the adjustment plate 6 and an elongated slot 25 in the base plate 5, can be loosened to permit the motor M and drive means D (which are carried by the adjustment plate 6) to be slid toward or away from the hinges 3 on the base plate 5. Once the desired position is obtained, fasteners F are then tightened in place to prevent relative shifting of plates 5, 6 during use. As should be apparent, the further the rotary discs 17, 19 are from the hinges 13, the greater the maximum foot extension that will be produced (i.e., the position occurring when the crank arm is located as shown for the crank arm 15 that is connected to the rotary disc 19 in FIG. 1), while the opposite result will be produced with respect to the maximum foot flexion achievable (i.e., the flexion occurring as the crank arm moves into the position shown for the crank arm 15 that is connected to the rotary disc 17 in FIG. 1).

Furthermore, the angular range of movement producible during each cycle of oscillation can be adjusted by loosening the fasteners used to secure the crank arms 15 to the foot supports 11, and sliding each fastener along the elongated slot 27 formed in the connector plate 28 that is attached to the underside of each foot support 11. After the desired adjustment is made, the connection is resecured to prevent slipping of the crank arm relative to the foot support 11 during use. In this regard, it is noted that the closer to the hinge 13 that the crank arm 15 is connected, the greater the degree of ankle flexion-extension that will be produced. Accordingly, between these two adjustments, a wide range of control may be exercised over the oscillations of the foot supports 11 that will be produced by the drive D.

It is pointed out that it is not desirable for the pivoting action of the foot supports 11 to cause the entire body of the user to be shoved along the bed, table or the like 7 (as could possibly occur, particularly when both pedals are simultaneously pivoting in unison) while, at the same time, it is not desirable for the user's feet to come off of the foot supports 11 as they are swung rearwardly. Furthermore, for therapeutic or exercise purposes, it may be desired for the user to not merely passively allow his feet to follow the movements of the foot supports 11, but rather to have the user actively exercise by applying pressure to the foot supports. Accordingly, foot supports 11 are provided with foot straps 29, which can be adjustable in any conventional manner, and a pair of handle straps 30 are attached to the base plate 5 of the support 3, the former restraining the user's feet from lifting off of the foot supports 11 and the latter permitting him or her to increase the foot pressure applied to the foot supports 11 without overcoming the holding force of the fastening straps 9.

Figure 2:
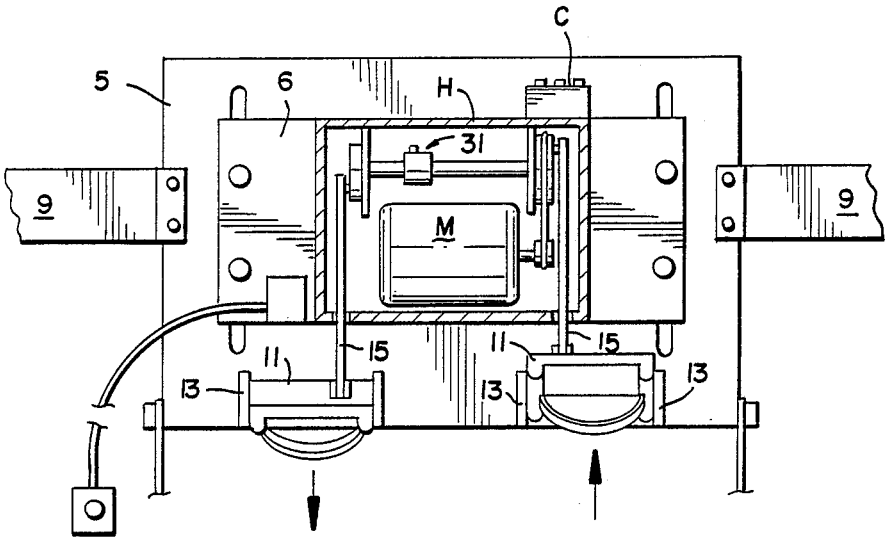
FIGS. 2 and 3 are partial sectional plan views illustrating the alternating and simultaneous flexing modes of operation of the preferred embodiment of FIG. 1.
Figure 3:
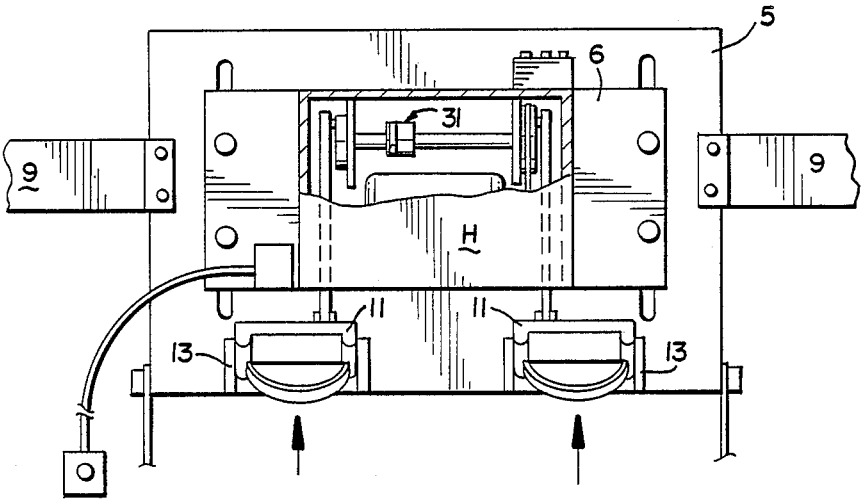

As noted at the outset, two modes of CPM physiotherapy are known, one which produces a simultaneous dorsiflexion of both feet in phase with each other (FIG. 3), and one which simulates a walking stride Wherein each foot alternately undergoes flexion and extension 180 degrees out of phase relative to the other (FIGS. 1, 2). In accordance with the present invention, not only can both of these modes of operation be obtained, but also the device can be changed from one of these operating modes to the other without the use of tools or otherwise attaching and reattaching parts. In particular, in accordance with the present invention, the changeover between these modes is obtained simply by reversing the direction of operation of the motor M.

When one of the crank discs is coupled to the other by a connector shaft for enabling both of the crank discs 17, 19 to be driven by a single output shaft of the motor M (as is the case with the embodiment of FIG. 1), this changeover can be achieved by the provision of a lost motion coupling disposed between the motor and only one of the two crank arms 15. One such lost motion coupling arrangement that is suitable for effecting such a changeover is illustrated in FIGS. 1–4, and is designated generally by the reference numeral 31.

Figure 4:
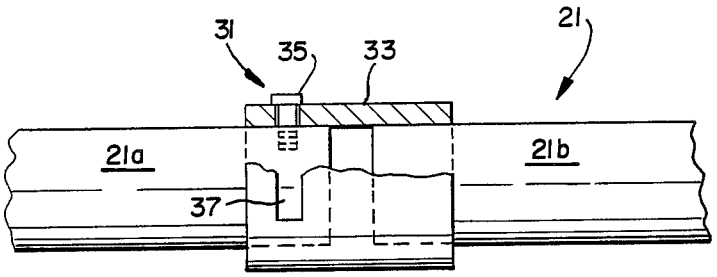
FIG. 4 is a partial sectional view of a lost motion coupling for the crank drive of the embodiment of FIGS. 1–3.

In particular, FIG. 4 shows a lost motion coupling arrangement 31 that is formed by using a connector shaft 21 that is formed of two shaft segments 21*a*, 21*b*, that are connected together in a manner permitting a defined degree of relative rotational movement therebetween. As illustrated, this connection is formed via a sleeve 33 that is fixedly secured to an end of shaft segment 21*b* and is coupled to the facing end of shaft segment 21*a* by a bolt 35 that is passed through a slot 37 in the sleeve 33 and then threaded into, or otherwise fixed to, shaft segment 21*a*. The slot 37 extends about the circumference of the sleeve 33 a sufficient distance to enable shaft segment 21*a* to be rotationally displaced 180 degrees relative to the shaft segment 21*b* as the bolt 35 moves from a position in abutment with one end of the slot 37 to a position in abutment with an opposite end of the slot 37.

Thus, assuming that the device is operating in the 180 degree out-of-phase mode of FIGS. 1 and 2, the connector shaft 21 being rotated, for example, in a counterclockwise direction by the motor M, the bolt 35 would be in a position of abutment with the most clockwise disposed end of slot 37. If it were then desired to use the device 1 to produce a simultaneous dorsiflexion mode of operation (FIG. 3), the motor M can be caused to rotate in an opposite direction, clockwise for the illustrated embodiment, with the result that the foot support 11 that is attached to the disc 19 will be shifted into an in-phase alignment with the other foot support 11. This shifting occurs because rotation of the shaft segment 21*b*, as a result of the rotation of the disc 19, will not be transmitted to the shaft segment 21*a* until it has been rotated 180 degrees. After the shaft segment 21*b* has been rotated 180 degrees, the bolt 35 will abut against the counterclockwise most disposed end of slot 37, and from that point on, shaft segment 21*a* will rotate together with the shaft segment 21*b*, thereby causing rotation of the disc 17. As a result, the two foot supports 11 will now produce a synchronous pumping action of both feet. Of course, anytime that it is desired to once again simulate a walking stride-type flexion and extension movement, this process can be reversed.

With respect to controlling operation of the motor M, it is contemplated that primary and secondary controllers will be provided. In particular, a primary controller C will be carried by the housing H and used to start, stop, and select the rotational direction of motor operation (thereby selecting the mode of dorsiflexion), while a secondary, remote controller R would be provided having a rheostat for controlling the speed of operation of the motor and which could be held in the hand of the user of the device, if desired. However, it should be appreciated that the specific details of the motor controls, themselves, form no part of the invention, any suitable known control apparatus being usable.

Figure 5:
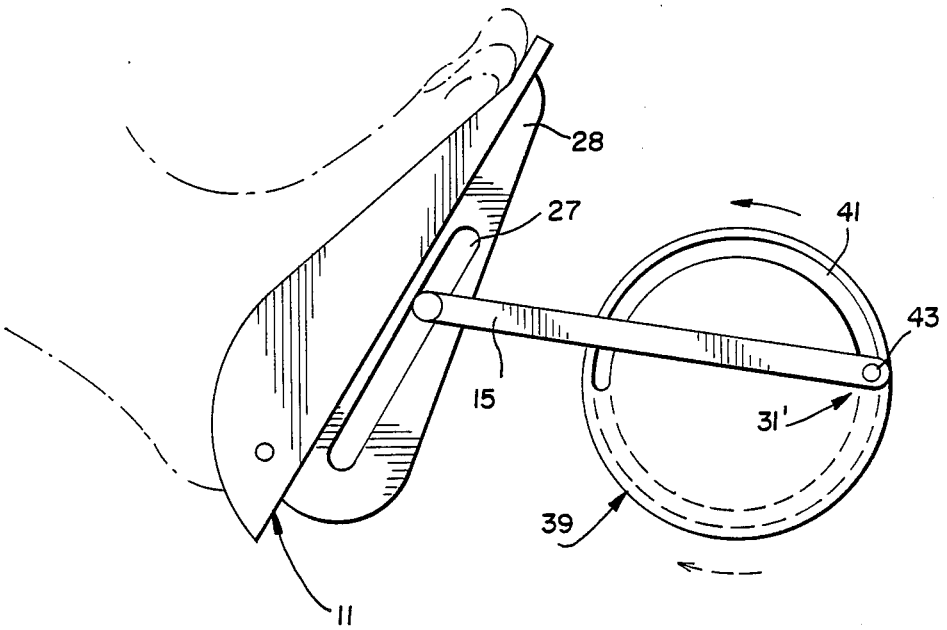
FIG. 5 is an alternative lost motion coupling arrangement for the embodiments of FIGS. 1–3.

It is also noted that, instead of incorporating the lost motion coupling arrangement into the connector shaft 21, the lost motion coupling can be incorporated into the connection between one of the crank arms 15 and one of the rotary discs. Such an arrangement is illustrated in FIG. 5 and designated generally by the reference numeral 31'. In particular, by connecting the crank arm 15 to a rotary disc 39 that has been modified so as to have an arcuate slot 41, within which a link pin 43, connecting the crank arm 15 to the rotary disc 39, is received, the same lost motion effect produced by the arrangement of FIG. 4 can be obtained. For example, if disc 39 is rotating in a counterclockwise direction (solid arrow), the link pin 43 will abut the most clockwise disposed end of slot 41 (as represented in solid lines in FIG. 5). However, should rotation of the disc 39 be reversed into a clockwise rotation (broken arrow), the crank arm 15 would remain in its illustrated location until such time as the pin 43 has travelled the length of slot 41 into a position of abutment with the opposite end thereof (which occurs when slot 41 reaches the broken line illustrated position). In this way, despite the fact that both rotary discs are moving during a mode change, one foot support can be brought into or out of phase alignment with the other.

Figure 6:
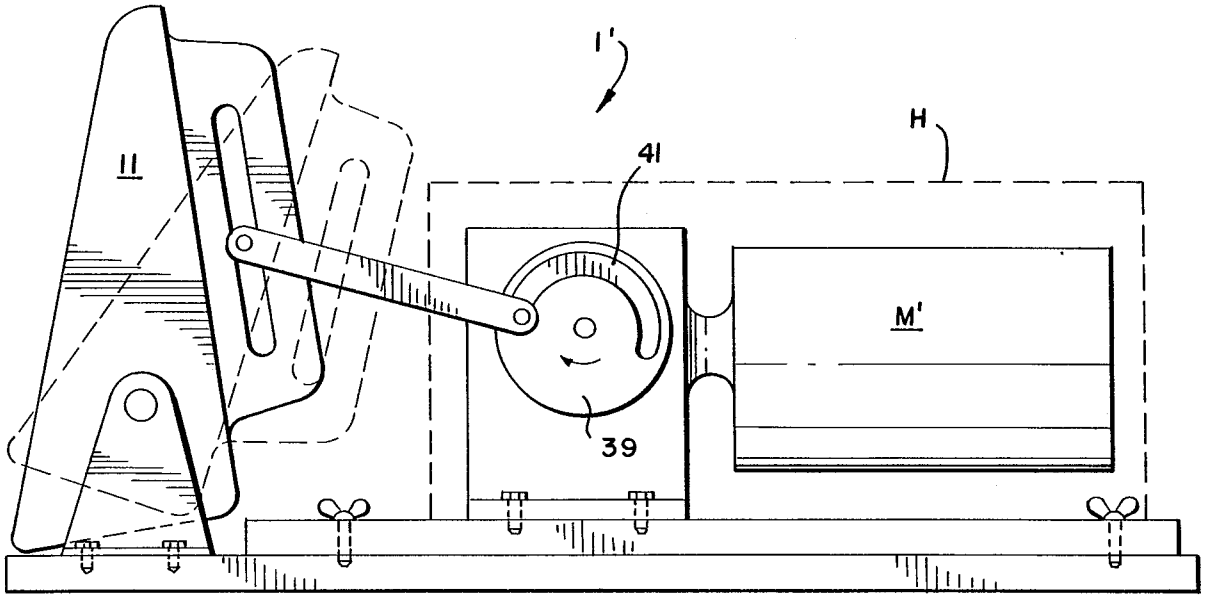
FIGS. 6 and 7 are side elevational views of a second preferred embodiment in accordance with the present invention in alternating and simultaneous flexing modes, respectively.

The lost motion coupling arrangement 31' is particularly desirable, not only because of its simplicity, but also because it is particularly suitable for enabling the use of a reversible gear motor having double output shafts as the motor for powering the device. Such a modified device 1' is illustrated in FIGS. 6–8, wherein like numerals are utilized to designate components common to both embodiments and prime (') designations are utilized to indicate that a corresponding component device 1' has been modified relative to its form in device 1.

Figure 7:
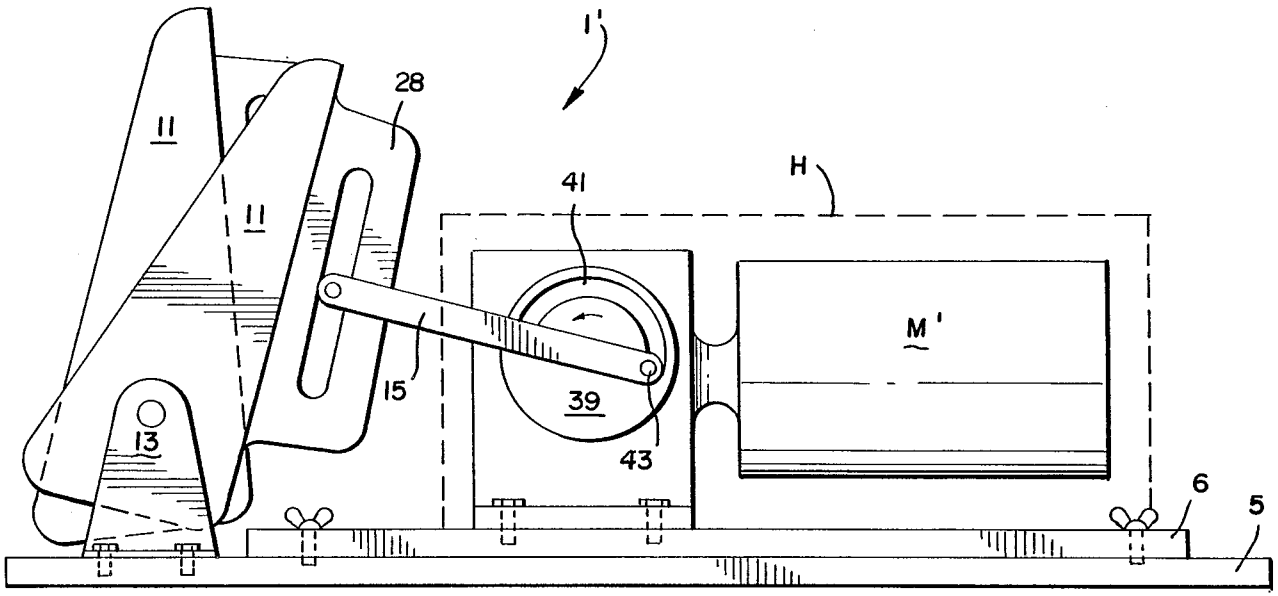
Figure 8:
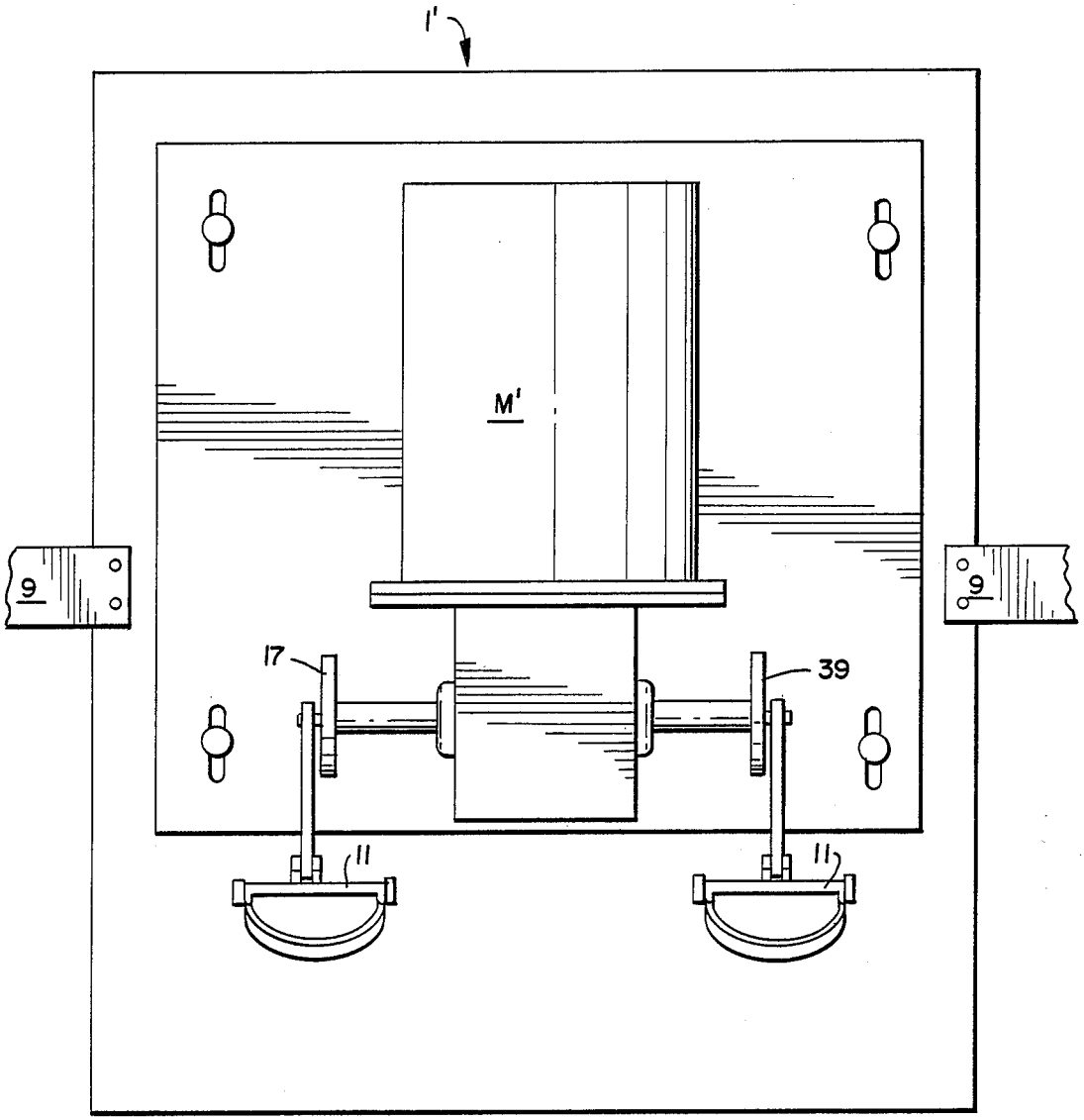
FIG. 8 is a plan view of the modified embodiment of FIGS. 7 and 8.

As can be seen from FIGS. 7–8, by using a double-shafted gear motor M' and the FIG. 5 lost motion coupling arrangement (the only material differences existing between the manipulating devices 1 and 1'), a more compact device having fewer components is achievable. As can be seen from FIGS. 6 and 7, if simultaneous dorsiflexion is being produced in phase with disc 39 rotating in a clockwise direction (FIG. 6), by reversing the direction of operation of motor M', so that disc 39 now rotates in a counterclockwise direction, the foot support 11 that is connected to this rotary disc 39 will not be further displaced until connecting pin 43 abuts the opposite end of slot 41, after which foot supports 11 will be 180 degrees out of phase with respect to each other (see FIG. 7).

Figure 9:
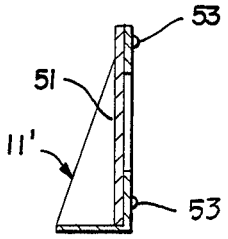
FIGS. 9 and 10 are, respectively, vertical crosssectional and front elevational views of modified foot support structure for use in accordance with another aspect of the present invention.
Figure 10:
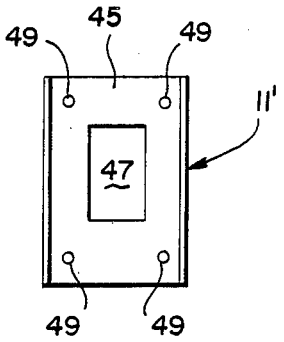
Figure 11:
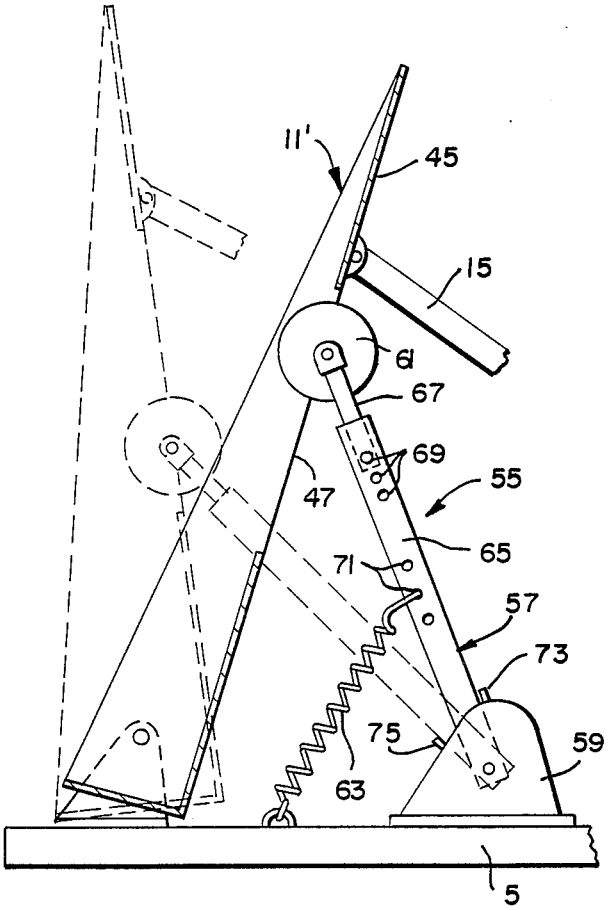
FIG. 11 is a vertical partial sectional side view of a sole-massaging roller assembly for use with the foot support arrangement of FIGS. 9 and 10.

With reference to FIGS. 9–11, another aspect of the present invention, applicable to either of devices 1, 1', will be described. This feature provides a means for massaging the soles of feet placed upon modified foot supports 11' as a further mode of physiotherapeutic manipulation.

Foot support 11' differs from the previously described foot support 11 in that a foot supporting wall 45 thereof is provided with an elongated aperture 47 and a plurality of attachment holes 49, as well as a detachable cover plate 51 that is sized to completely cover the foot supporting wall 45. Cover plate 51 is secured in place on wall 45, via attachment holes 49, by either conventionally shaped, integrally formed fastening clips 53 (which can be snapped on and off) or any other conventional fastening means may be used, such as threaded screw receiving projections on the bottom of cover plate 51 which receive screws threaded therein from the opposite side of foot supporting wall 45. When it is desired to use the device in the two modes described previously, cover plate 51 would be attached in place upon the foot supports 11'. However, when it is desired to make use of a foot massage mode, to be described hereafter, the cover plate 51 can be easily and quickly removed.

FIG. 11 shows one form of foot massaging means, designated generally by the reference numeral 55, for use with the modified foot support 11' of FIGS. 9 and 10. Foot massaging means 55 is comprised of a roller arm 57 that is pivotally mounted to the base plate 5, at a first end thereof, via an arm hinge 59 and carries a roller 61 at a second end thereof. Furthermore, the massaging means 55 also includes a resilient biasing means, such as the coil spring 63, which is connected between the base plate 5 and an intermediate portion of the roller arm 57. The roller arm 57, itself, is in the form of a hollow tube 65 within which a roller mount 67 is telescopingly received and attachable in any one of a plurality of positions of extension and retraction via a respective one of a number of attachment holes 69. Additionally, the tube 65 is provided with a plurality of attachment holes 71, or other forms of connectors, by way of which the end of coil spring 63 can be secured to the tube 65 at various points along its length to thereby vary the spring force that will be exerted upon it by the spring 63 due to the resultant increasing or reducing of the length of coil spring 63.

As will be appreciated from a comparison of the solid line and phantom line illustrations of FIG. 11, under the biasing effect of spring 63, the roller 61 is caused to extend through the elongated slot 47 in the foot supporting wall 45 into contact with the sole of a foot placed thereon. By adjusting the attachment position of roller mount 67, it can be assured that roller 61 will be properly located within the elongated aperture 47 throughout the range of pivoting of the foot support 11', which still may be varied in the manners described above. In this regard, it can be seen how the roller 61 will reciprocate along the length of the elongated slot 47 during swinging of the foot support 11', toward the toes as the foot is extended, and toward the heel as the foot is flexed. The range of this reciprocative movement should extend at least along the full length of the arch between the ball and the heel of the foot. Furthermore, if desired, adjustably positionable stops 73, 75 can be utilized to limit the range of reciprocative movement of the roller 61 within the elongated slot 47 to an extent less than that permissible by the length of the elongated slot 47 or these stops may merely be used to prevent the roller 61 from being forced out of the elongated slot 47 by the pressure applied by the foot of the user, as the roller 61 reaches either end of the elongated slot 47.

From the foregoing, one of ordinary skill in the art should now be able to recognize how the present invention achieves all of the initially set forth objects by providing a physiotherapy foot manipulating device that is capable of multiple modes of operation, that is capable of being changed from one mode of operation to another quickly, easily, and without the use of tools, and which is simple in construction and economical to produce. Additionally, it should be appreciated how the device is constructed as a portable unit that may be used, e.g., at home or in a hospital, with or without medical supervision, in a wide range of therapeutic and exercise circumstances.

Lastly, while I have shown and described various embodiments in accordance with the present invention, it should be recognized that the present invention is not limited to such embodiments, but is susceptible of numerous changes and modifications as will be known to those skilled in the art. Therefore, I do not wish to be limited to the details shown and described herein, and intend to cover all such changes and modifications as are encompassed by the scope of the appended claims.

I claim:

1. A multi-mode physiotherapy foot manipulating device comprising: a support, a reversible motor and a pair of pivotally oscillatable foot supports carried by said support, and drive means for interconnecting said reversible motor with each of said foot supports, said drive means including means for changing the oscillating phase, relationship of one of said foot supports relative to the other of said foot supports when the direction of operation of said reversible motor is reversed, whereby said foot supports are selectively oscillatable in an in-phase, simultaneous dorsiflexing action and an out-of-phase dorsiflexing action.

2. A multi-mode physiotherapy foot manipulating device according to claim 1, wherein said drive means comprises a pair of crank arms, each of which is connected to a respective one of said foot supports at one end and to a respective rotary crank disc at an opposite end thereof, and wherein each rotary crank disc is rotatably driven by said motor.

3. A multi-mode physiotherapy foot manipulating device according to claim 2, wherein said means for changing the oscillating phase comprises a lost motion coupling provided between said motor and only one crank arm of said pair of crank arms.

4. A multi-mode physiotherapy foot manipulating device according to claim 3, wherein said lost motion coupling comprises a 180 degree arcuate slot formed in one of said crank discs, said opposite end of said one crank arm being connected to said one crank disc by a connector that is slidably received in said arcuate slot.

5. A multi-mode physiotherapy foot manipulating device according to claim 4, wherein said motor has a double-ended output shaft, each end of which is coupled to a respective one of said drive discs.

6. A multi-mode physiotherapy foot manipulating device according to claim 4, wherein said one of the crank discs is coupled to the other by connector shaft means for enabling both of the crank discs to be driven by a single output shaft of said motor.

7. A multi-mode physiotherapy foot manipulating device according to claim 3, wherein said one of the crank discs is coupled to the other by connector shaft means for enabling both of the crank discs to be driven by a single output shaft of said motor.

8. A multi-mode physiotherapy foot manipulating device according to claim 7, wherein said lost motion coupling is formed as, part of said connector shaft means.

9. A multi-mode physiotherapy foot manipulating device according to claim 2, wherein said support is comprised of a base plate and an adjustment plate; wherein said base plate is provided with means for securing the device to a bed, table or the like and with hinge means for pivotally mounting said foot supports; wherein said motor and crank discs are carried by said adjustment plate; and wherein said adjustment plate is mounted upon said base plate in a manner enabling the adjustment plate to be fixed in any of a plurality of positions disposed at varying distances from said hinge means for varying the extent of flexion and extension produced during oscillation of said foot supports.

10. A multi-mode physiotherapy foot manipulating device according to claim 9, wherein said one end of each of the crank arms is connected to the respective foot support by an adjustable connector means for enabling the distance between said one end of the crank arm and said hinge means to be varied for varying the degree of flexion and extension produced during oscillation of said foot support.

11. A multi-mode phystiotherapy foot manipulating device according to claim 1, wherein said support is provided with straps having hand grip means for enabling a reclining user to adjust the pressure of the user's feet against the foot supports and to prevent displacement of the user's body as a result of the oscillations of the foot supports.

12. A multi-mode physiotherapy foot manipulating device according to claim 1, further comprising means for massaging the soles of feet placed on said foot supports while the foot supports are oscillated.

13. A multi-mode physiotherapy foot manipulating device according to claim 12, wherein said foot supports comprise a pedal having an elongated aperture in a foot supporting wall thereof; and wherein said means for massaging comprises a roller arm pivotally mounted to said support at a first end thereof and having a roller rotatably mounted to a second end thereof, and spring means connected between said support and said roller arm for resiliently biasing said roller arm into a position wherein said roller extends through said aperture and for enabling said roller to reciprocate along the length of said elongated slot during the oscillations of the foot supports.

14. A multi-mode physiotherapy foot manipulating device according to claim 13, wherein the distance between said roller and the first end of the roller arm is adjustable and means is provided for connecting the spring means to the roller arm at a plurality of locations along the length of said roller arm.

15. A multi-mode physiotherapy foot manipulating device according to claim 13, wherein a cover plate is provided for detachably mounting on said foot supporting wall in a manner for selectively covering and uncovering said aperture.

16. A multi-mode physiotherapy foot manipulating device according to claim 13, wherein said drive means comprises a pair of crank arms, each of which is connected to a respective one of said foot supports at one end and to a respective rotary crank disc at an opposite end thereof, and wherein each rotary crank disc is rotatably driven by said motor.

* * * * *